US007213318B1

(12) United States Patent
Fa

(10) Patent No.: US 7,213,318 B1
(45) Date of Patent: May 8, 2007

(54) KNOCKING TOOL

(76) Inventor: Kang Hsin Fa, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/485,262

(22) Filed: Jul. 13, 2006

(51) Int. Cl.
*B25B 27/14* (2006.01)

(52) U.S. Cl. ..... 29/275

(58) Field of Classification Search ..... 29/275, 29/254–255, 280, 282, 263, 235, 271; 81/463
See application file for complete search history.

(56) References Cited

U.S. PATENT DOCUMENTS 3,994,615 A * 11/1976 Narang ..... 408/226

5,399,051 A * 3/1995 Aken et al. ..... 408/233

* cited by examiner

*Primary Examiner*—Robert C. Watson

(57) ABSTRACT

A knocking tool comprises a handle having an inclined cambered groove; one end of the cambered groove being at a first end surface of the handle; the first end surface of the handle having at least one insertion hole; an outer lateral wall of the handle having at least one through hole which is communicated to the respective insertion holes; and at least one joint assembled to the first end surface of the handle; one surface of the joint being installed with at least one insertion rod which is inserted into the insertion holes; a retainer being inserted into the respective through hole so as to tightly engage the insertion rod to the insertion hole. A connecting rod is assembled to the insertion groove of the handle; and one end of the connecting rod has a combining portion. The combining portion is formed with combining holes.

2 Claims, 5 Drawing Sheets

KNOCKING TOOL

FIELD OF THE INVENTION

The present invention relates to hand tools, and in particular to a knocking tool for detaching and assembling an oil sealing, a bearing, a gear, and other parts in a car easily and conveniently without damage the parts.

BACKGROUND OF THE INVENTION

The power of car is mainly from the engine in that fuel and air are mixed with a predetermined ratio. A spark plug is used to ignite the fuel to combust air to expand rapidly. Thus the piston is pushed to move reciprocally so as to generate power. The power is transferred to a crank through a linkage to drive a car. Other than piston, linkage, crank shaft, the cylinder and air value are also important components for the reciprocal operated engine. The operation of the piston is induced the friction of the wall of the cylinder so that the oil seal will become worse and thus it cannot tightly seal the opening of the cylinder. As a result, oil will flow into the surface of the engine so as to damage the top surface of the plug, inner wall of the cylinder, surface area of the valve, etc., and thus the power is insufficient. Thus the oil sealing must be detached for repair. Thereby above mentioned linkage, crank shaft, bearings, and gears must be updated as they are used for a long time, otherwise the safety of driving will be affected.

Generally, in updating the oil sealing, the old parts must be detached for updating a new one. In the old operation, the oil sealing is engaged to a valve rod and then a force is used to enforce the oil sealing into the valve. Generally, a car has many parts which must be assembled into an engine chamber so that the residue space is very small and the operation for assembling the oil sealing is very difficult. Furthermore, the assembling of bearings, gears, etc., uses a long rod (such as an opener or a socket) to resist against a surface of a part and then a hammer is used to knock the part. Furthermore, the centers of the oil sealing, bearings, and gears have an axial rod. In knocking, it must take care not to damage the surface of the axial rod. Thus in knocking, the position of a resisting tool must be displaced to avoid the parts to be damaged.

SUMMARY OF THE INVENTION

Accordingly, the primary object of the present invention is to provide a knocking tool for detaching and assembled the oil sealing, bearings, gears, and other parts in a car easily and conveniently without damage the parts.

To achieve above objects, the present invention provides a knocking tool which comprises a handle having an inclined cambered groove; one end of the cambered groove being at a first end surface of the handle; the first end surface of the handle having at least one insertion hole; an outer lateral wall of the handle having at least one through hole which is communicated to the respective insertion holes; and at least one joint assembled to the first end surface of the handle; one surface of the joint being installed with at least one insertion rod which is inserted into the insertion holes; a retainer being inserted into the respective through hole so as to tightly engage the insertion rod to the insertion hole. A connecting rod is assembled to the insertion groove of the handle; one end of the connecting rod has a combining portion; the combining portion is formed with combining holes, in assembly, the combining holes are aligned with the through holes of the insertion groove and then the retainers pass through the through holes to enter into the combining holes so as to fix the connecting rod to the handle.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
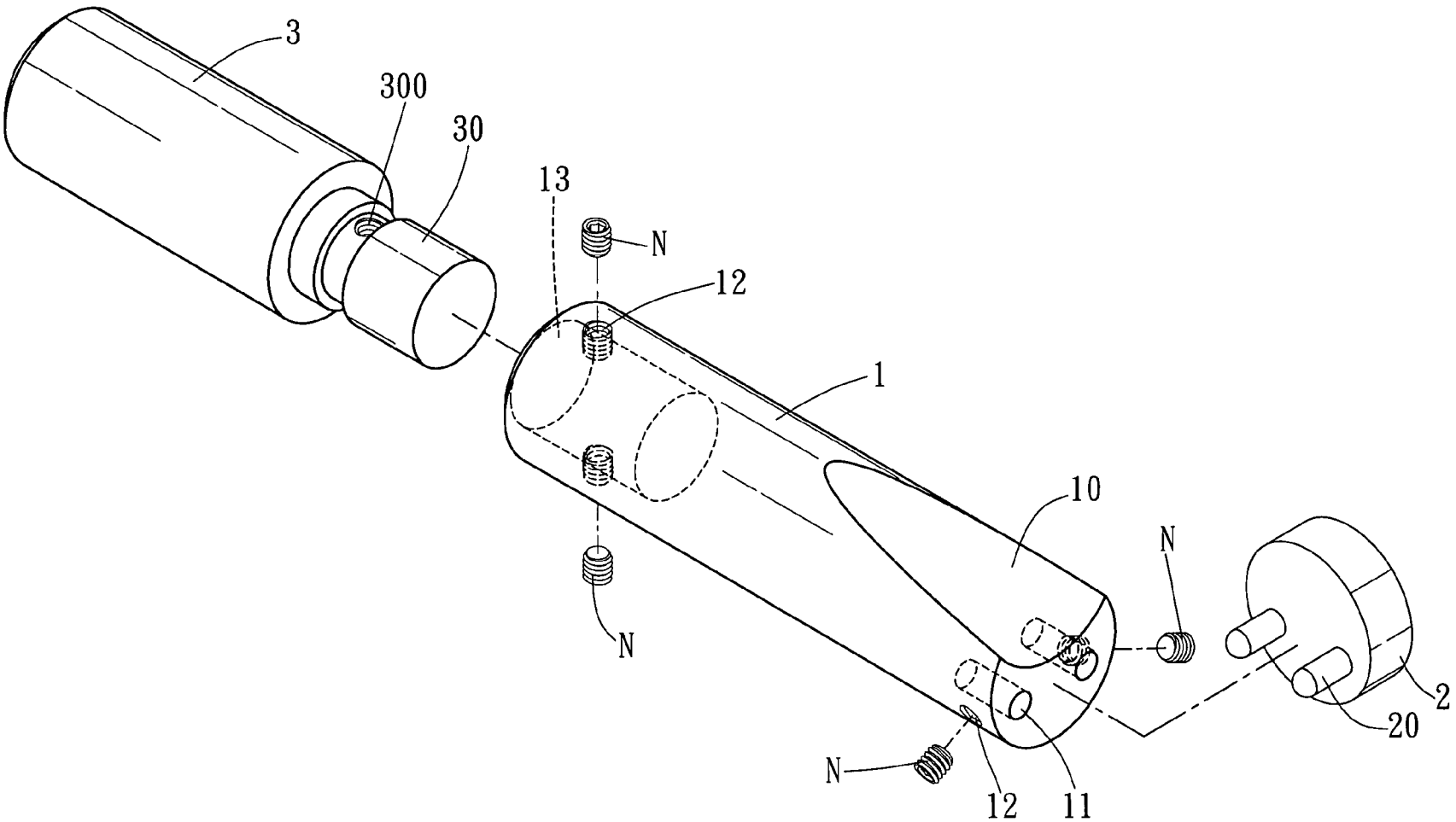
FIG. 1 is an exploded perspective view of the present invention.
Figure 2:
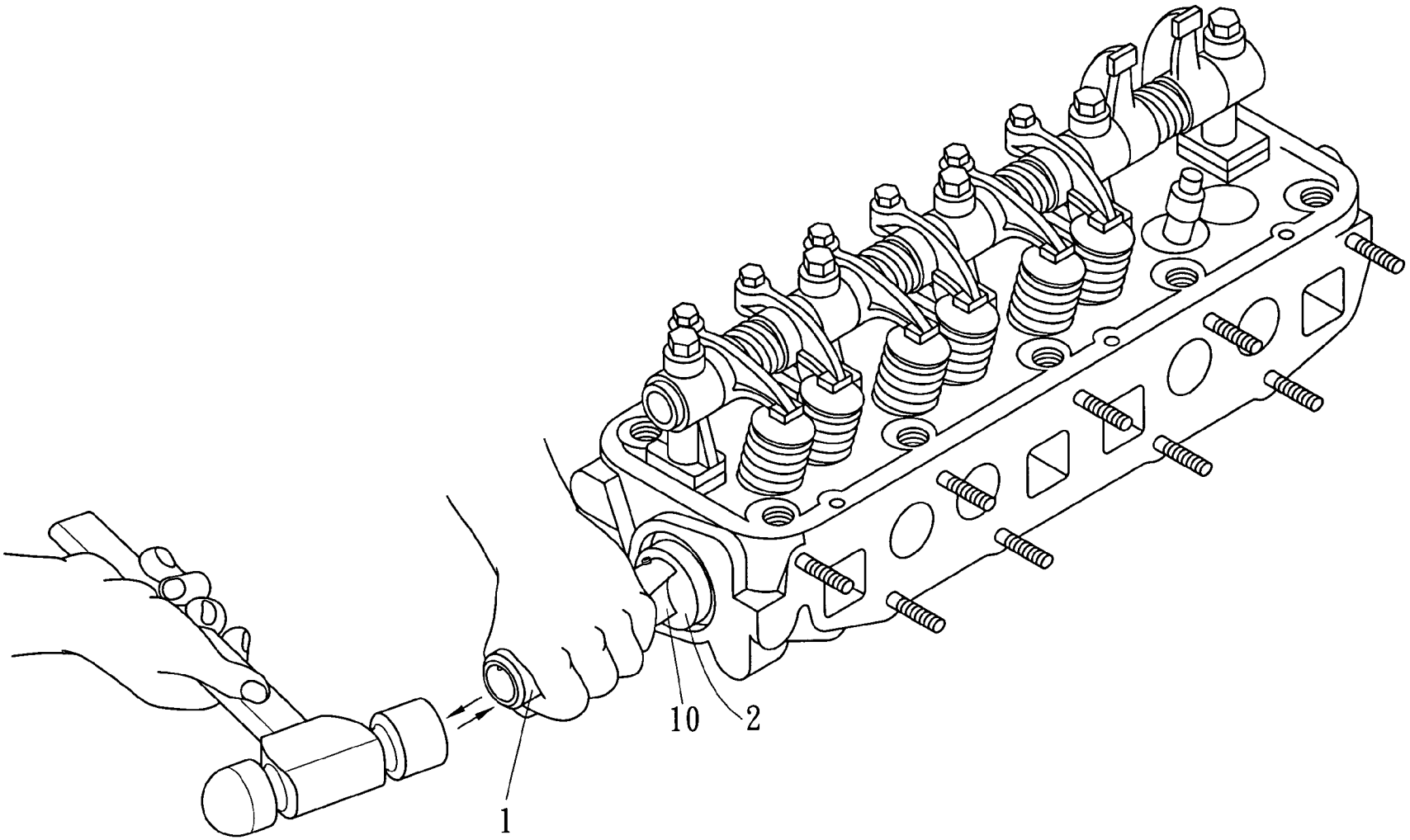
FIG. 2 shows the operation of the present invention.
Figure 3:
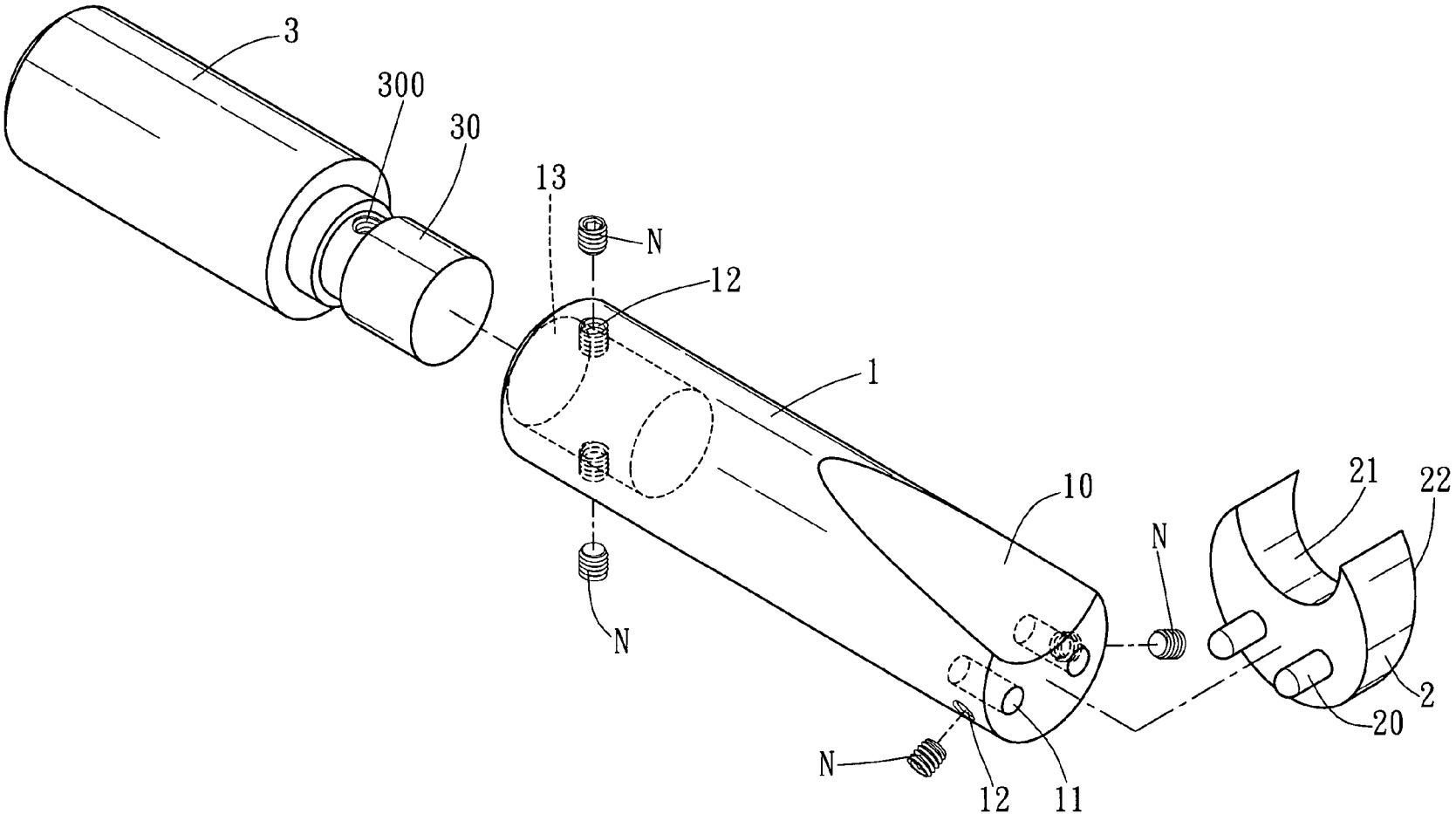
FIG. 3 is another exploded perspective view of the present invention.

Referring to FIGS. 1, 2 and 3, the structure of the present invention is illustrated. The present invention has the following elements.

A handle 1 has an inclined cambered groove 10. One end of the cambered groove 10 is at a first end surface of the handle 1. The first end surface of the handle 1 has at least two insertion holes 11. An outer lateral wall of the handle 1 has through holes 12 which are communicated to the respective insertion holes 11. A second end surface of the handle 1 has an insertion groove 13. An outer wall of the handle 1 has at least one through hole 12 corresponding to the insertion groove 13.

At least one disk like joint 2 is assembled to the first end surface of the handle 1. One surface of the joint 2 is installed with two insertion rods 20 which are inserted into the insertion holes 11. A retainer N is inserted into the respective through hole 12 so as to tightly engage the insertion rod 20 to the insertion hole 11. In one embodiment, the joint 2 can be formed with a notch 21 with a shape corresponding to that of the cambered groove 10 and the lateral surface of the joint 2 is an inclined surface. The retainer N may be a pin which can be inserted into the through hole 12 by using an elastic unit.

A connecting rod 3 is assembled to the insertion groove 13 of the handle 1. One end of the connecting rod 3 has a combining portion 30. The combining portion 30 is formed with combining holes 300. In assembly, the combining holes 300 are aligned with the through holes 12 of the insertion groove 13 and then the retainers N pass through the through holes 12 to enter into the combining holes 300 so as to fix the connecting rod 3 to the handle 1.

In assembly and use of the present invention, referring to FIGS. 1 and 2, a joint 2 is assembled to the insertion groove 13 of the handle 1. The insertion rods 20 of the joint 2 are inserted into the insertion holes 11 of the handle 1. Then retainers N are inserted into the through holes 12 so as to fix the joint 2 to the handle 1. In use, the joint 2 is resisted to a part to be detached, such as an oil sealing, a bearing or a gear. The operator holds the handle 1 by one hand and knocks the distal end of the handle 1 by a hammer. Thus, the joint 2 is adhered to the part and force can be uniformly applied to the part. Thus the operation can be performed rapidly and easily.

Figure 4:
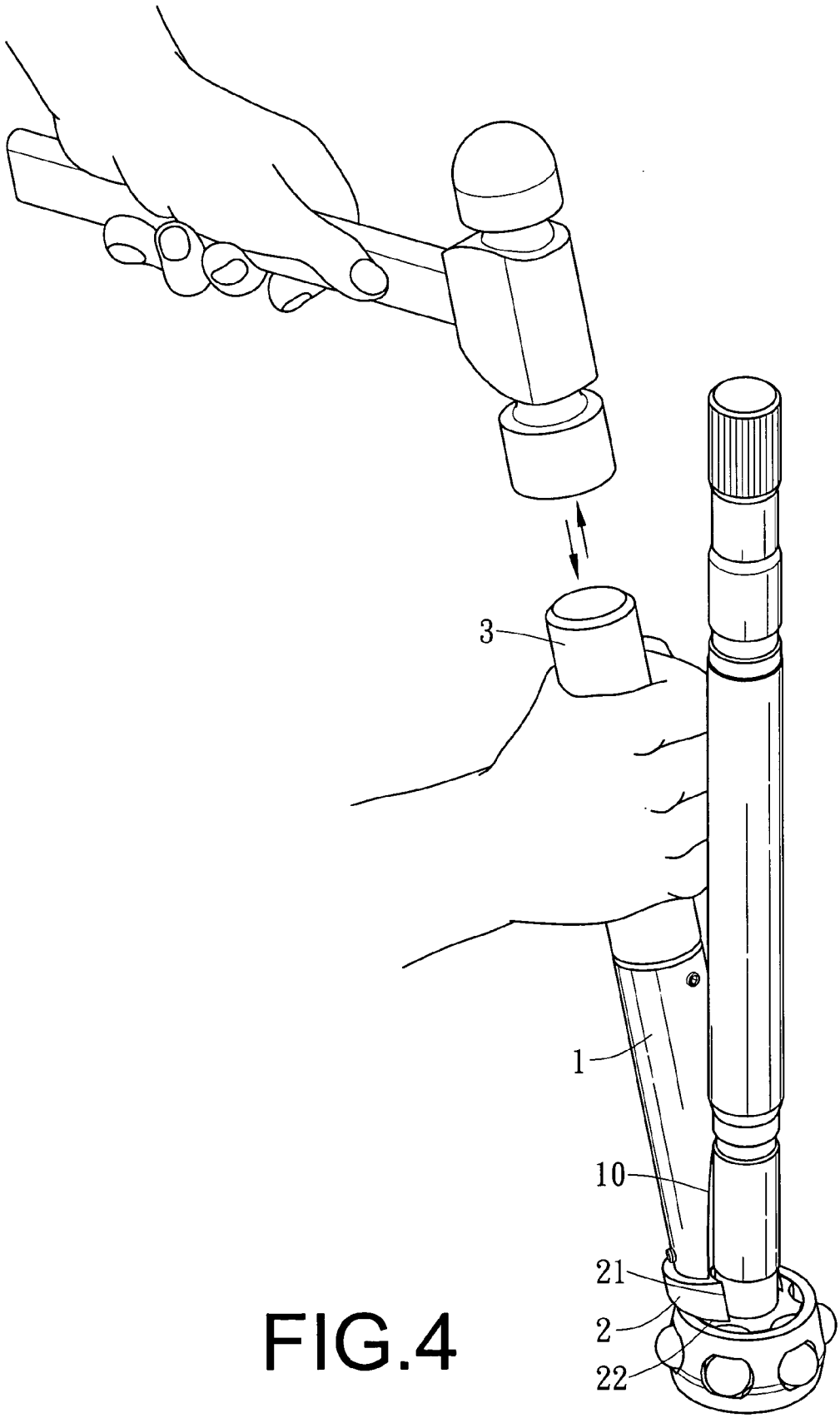
FIG. 4 shows another operation of the present invention.

If the part to be detached has an axial rod so that the disk like joint 2 can not be well adhered to the part, as shown in FIGS. 3 and 4, a joint 2 with a notch 21 can be used. In use, the notch 21 is aligned to the cambered groove 10 of the handle 1. The combining portion 30 of connecting rod 3 is inserted to the insertion groove 13 of the handle 1. The combining holes 300 of the connecting rod 3 are aligned to the through holes 12 of the handle 1 and then the retainers N are inserted into the through hole 12 so that the connecting rod 3 is tightly engaged to the handle 1. In operation, the notch 21 of the joint 2 and the cambered groove 10 of the handle 1 are arranged at one side of the axial rod. The inclined surface 22 of the joint 2 resists against the part to be detached (such as an oil sealing, a bearing or a gear). The operator holds the connecting rod 3 by one hand and knocks the distal end of the connecting rod 3 by a hammer. Since the cambered groove 10 of the handle 1 has an inclined surface, the handle 1 and the connecting rod 3 will shift outwards. The operation can be performed easily. Furthermore, the notch 21 of the joint 2 and the cambered groove 10 of the handle 1 can be conveniently displaced axially so as to change the knocking position. The forces can be uniformly applied to the part and the operation can be performed easily and quickly.

Figure 5:
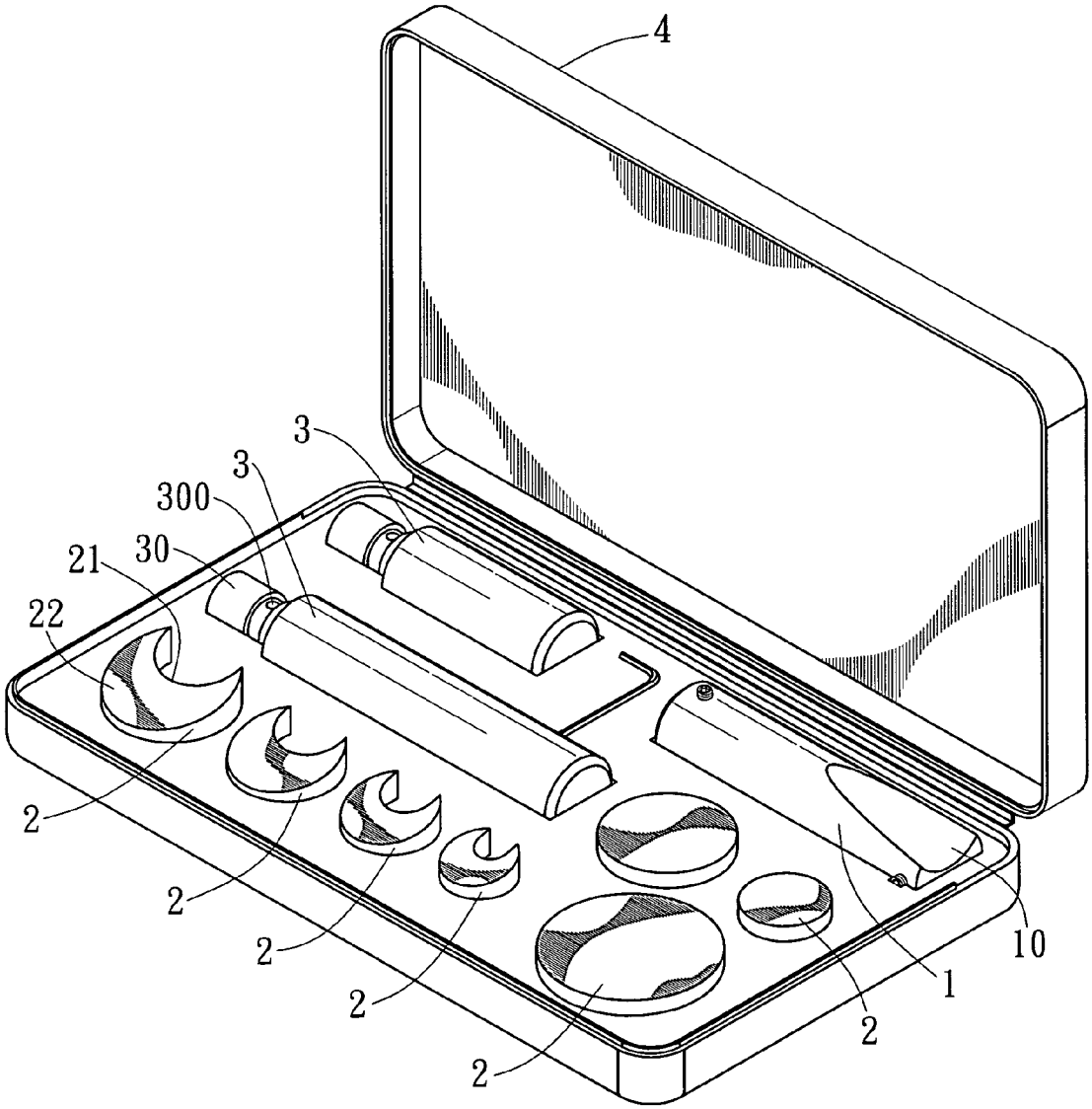
FIG. 5 is a schematic view showing that the present invention can be received in a toolbox.

If it is desired to assemble a part (such as an oil sealing, a bearing or a gear), the part is sleeved around an axial rod, and then the present invention and hammer are used to knock the part to a desired position. The operation is convenient and rapid. The present invention includes a handle 1, a plurality of joints 2 of different specifications, and at least one connecting rod 3 of different size. The present invention can be received in a toolbox 4, as shown in FIG. 5. Thereby the present invention can be arranged to match the kinds of cars, parts (such as oil sealings, bearings or gears).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A knocking tool comprising:

a handle having an inclined cambered groove; one end of the cambered groove being at a first end surface of the handle; the first end surface of the handle having at least one insertion hole; an outer lateral wall of the handle having at least one through hole which is communicated to the respective insertion holes; and at least one joint assembled to the first end surface of the handle; one surface of the joint being installed with at least one insertion rod which is inserted into the insertion holes; a retainer being inserted into the respective through hole so as to tightly engage the insertion rod to the insertion hole; and wherein the joint is formed with a notch with a shape corresponding to that of the cambered groove.

2. The knocking tool as claimed in claim 1, wherein a lateral surface of the joint is an inclined surface.

* * * * *